US008151558B2

(12) United States Patent
Robel et al.

(10) Patent No.: US 8,151,558 B2
(45) Date of Patent: Apr. 10, 2012

(54) EXHAUST SYSTEM IMPLEMENTING SCR AND EGR

(75) Inventors: Wade J. Robel, Peoria, IL (US); James J. Driscoll, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 1074 days.

(21) Appl. No.: 12/010,958

(22) Filed: Jan. 31, 2008

(65) Prior Publication Data

US 2009/0193794 A1 Aug. 6, 2009

(51) Int. Cl.
*F02M 25/06* (2006.01)
*F01N 3/00* (2006.01)
*F01N 3/10* (2006.01)

(52) U.S. Cl. ..... 60/295; 60/278; 60/297; 60/299; 60/301; 60/303

(58) Field of Classification Search ..... 60/278, 60/295, 297, 299, 301, 303, 311
See application file for complete search history.

(56) References Cited

U.S. PATENT DOCUMENTS 3,791,143 A 2/1974 Keith et al.
4,912,776 A 3/1990 Alcorn
6,125,629 A 10/2000 Patchett
6,212,885 B1 4/2001 Hirota et al.
6,681,565 B2 1/2004 Russell
6,732,507 B1 5/2004 Stanglmaier et al.
6,805,849 B1 10/2004 Andreasson et al.
6,823,660 B2 11/2004 Minami
6,826,906 B2 12/2004 Kakwani et al.
6,832,473 B2 * 12/2004 Kupe et al. ..... 60/286
6,843,971 B2 1/2005 Schäfer-Sindlinger et al.
6,846,464 B2 1/2005 Montreuil et al.
6,871,489 B2 3/2005 Tumati et al.
6,871,490 B2 3/2005 Liang et al.
6,928,806 B2 8/2005 Tennison et al.
6,973,776 B2 12/2005 van Nieuwstadt et al.
7,005,116 B2 * 2/2006 Schafer-Sindlinger et al. ..... 423/239.2
7,055,313 B2 6/2006 Russell
7,065,958 B2 6/2006 Funk et al.

(Continued)

FOREIGN PATENT DOCUMENTS

JP 07-071234 3/1995

(Continued)

OTHER PUBLICATIONS

U.S. Appl. No. 11/646,514, filed Dec. 28, 2006 entitled "Exhaust Treatment System".

(Continued)

*Primary Examiner* — Thomas Denion
*Assistant Examiner* — Audrey K Bradley
(74) *Attorney, Agent, or Firm* — Finnegan, Henderson, Farabow, Garrett & Dunner LLP

(57) ABSTRACT

An exhaust system for use with an engine is disclosed. The exhaust system may have an exhaust passageway, a reduction catalyst located within the exhaust passageway, and a particulate filter located within the exhaust passageway upstream of the reduction catalyst. The exhaust system may also have an oxidation catalyst located within the exhaust passageway upstream of the reduction catalyst to provide a desired ratio of $NO:NO_2$ to the reduction catalyst, and an exhaust gas recirculation loop. The exhaust gas recirculation loop may be situated to receive exhaust from the exhaust passageway at a location upstream of the oxidation catalyst and downstream of the particulate filter.

18 Claims, 3 Drawing Sheets

U.S. PATENT DOCUMENTS

| | | | | |
|---|---|---|---|---|
| 7,107,764 | B1 * | 9/2006 | Opris et al. | 60/297 |
| 7,143,578 | B2 | 12/2006 | Kakwani et al. | |
| 7,178,328 | B2 | 2/2007 | Solbrig | |
| 2004/0258594 | A1 * | 12/2004 | Andreasson et al. | 423/239.1 |
| 2005/0031514 | A1 | 2/2005 | Patchett et al. | |
| 2006/0213187 | A1 | 9/2006 | Kupe et al. | |
| 2007/0277507 | A1 * | 12/2007 | Yan | 60/286 |

FOREIGN PATENT DOCUMENTS

| | | | |
|---|---|---|---|
| JP | 09-004522 | | 1/1997 |
| JP | 11-093641 | | 4/1999 |
| JP | 002005002968 | | 6/2005 |
| WO | WO 99/39809 | | 8/1999 |
| WO | WO 03/054364 | | 7/2003 |
| WO | WO 2006/021748 | A1 | 3/2006 |
| WO | WO 2006041402 | A1 * | 4/2006 |

OTHER PUBLICATIONS

U.S. Appl. No. 11/709,809, filed Feb. 23, 20007 entitled "Exhaust Treatment System".

* cited by examiner

EXHAUST SYSTEM IMPLEMENTING SCR AND EGR

TECHNICAL FIELD

The present disclosure is directed to an exhaust system and, more particularly, to an exhaust system that implements selective catalytic reduction (SCR) and exhaust gas recirculation (EGR).

BACKGROUND

Internal combustion engines, including diesel engines, gasoline engines, gaseous fuel-powered engines, and other engines known in the art exhaust a complex mixture of air pollutants. These air pollutants are composed of gaseous compounds such as nitrogen oxides ($NO_X$), and solid particulate matter also known as soot. Due to increased awareness of the environment, exhaust emission standards have become more stringent, and the amount of $NO_X$ and soot emitted to the atmosphere by an engine may be regulated depending on the type of engine, size of engine, and/or class of engine.

In order to ensure compliance with the regulation of $NO_X$, some engine manufacturers have implemented a strategy called selective catalytic reduction (SCR). SCR is a process where a gaseous or liquid reductant, most commonly urea, is injected into the exhaust gas stream of an engine and is absorbed onto a substrate. The reductant reacts with $NO_X$ in the exhaust gas to form $H_2O$ and $N_2$. Although SCR can be effective, it is most effective when a concentration of NO to $NO_2$ supplied to the reduction catalyst is about 1:1. In order to achieve this optimum ratio, a diesel oxidation catalyst (DOC) is often located upstream of the substrate to convert NO to $NO_2$.

Another strategy used to reduce the emission of NOx is exhaust gas recirculation (EGR). EGR is a process where exhaust gas from the engine is recirculated back into the engine for subsequent combustion. The recirculated exhaust gas reduces the concentration of oxygen within the engine's combustion chambers, and simultaneously lowers the maximum combustion temperature. The reduced oxygen levels provide fewer opportunities for chemical reaction with the nitrogen present, and the lower temperature slows the chemical process that results in the formation of $NO_X$. A cooler is commonly located within the EGR loop to cool the exhaust before it is received by the engine.

In order to ensure compliance with the regulation of soot, some engine manufacturers remove the soot from the exhaust flow using a particulate trap. A particulate trap is a filter designed to trap soot in, for example, a wire mesh or ceramic honeycomb media. One type of particulate trap utilized in conjunction with diesel engines is known as a diesel particulate filter (DPF). The soot accumulated within the DPF can be burned away through a process called regeneration. For this purpose a regeneration device, for example a fuel-fired burner, can be located upstream of the DPF.

When combining SCR, soot collection and EGR together into one system, special considerations must be taken into account. For example, if the exhaust gas recirculated back into the engine is taken from downstream of the DOC, the received exhaust may be relatively rich in $NO_2$. As such, when the exhaust passes through the EGR cooler, some of the $NO_2$ gas may mix with moisture that condenses within the cooler and form nitric acid that can be corrosive to components of the engine. In similar manner, if the EGR loop receives exhaust from downstream of a urea injection location, the condensing moisture within the cooler may mix with residual ammonia to form ammonium nitrate, which can be unstable when mixed with diesel fuel.

An exemplary system implementing the strategies described above is disclosed in U.S. Pat. No. 6,823,660 (the '660 patent) issued to Minami on Nov. 30, 2004. This system includes an oxidation catalyst located upstream of a DPF, which in turn is located upstream of an SCR catalyst. The system also includes an EGR passage to direct exhaust from an associated engine at a location upstream of the oxidation catalyst back into the engine.

Although effective at controlling the amount of $NO_X$ and soot exhausted to the environment, the previously described system may fail to account for all of the special considerations. That is, because the EGR passage of the '660 patent receives exhaust from upstream of the DPF, the exhaust directed back into the engine may contain large amounts of particulates that can mix with condensation in the cooler to form sulfuric acid. In addition, the particulates can be damaging to engine components.

The system of the present disclosure solves one or more of the problems set forth above.

SUMMARY

One aspect of the present disclosure is directed to an exhaust system. The exhaust system may include an exhaust passageway, a reduction catalyst located within the exhaust passageway, and a particulate filter located within the exhaust passageway upstream of the reduction catalyst. The exhaust system may also include an oxidation catalyst located within the exhaust passageway upstream of the reduction catalyst to provide a desired ratio of $NO:NO_2$ to the reduction catalyst, and an exhaust gas recirculation loop. The exhaust gas recirculation loop may be situated to receive exhaust from the exhaust passageway at a location upstream of the oxidation catalyst and downstream of the particulate filter.

Another aspect of the present disclosure is directed to another exhaust system. This exhaust system may include an exhaust passageway, a reduction catalyst located within the exhaust passageway, and a particulate filter located within the exhaust passageway upstream of the reduction catalyst. The exhaust system may also include an injector located to inject reductant into the exhaust passageway upstream of the reduction catalyst, and an exhaust gas recirculation loop. The exhaust gas recirculation loop may be situated to receive exhaust from the exhaust passageway at a location upstream of the injector and downstream of the particulate filter.

DETAILED DESCRIPTION

Figure 1:
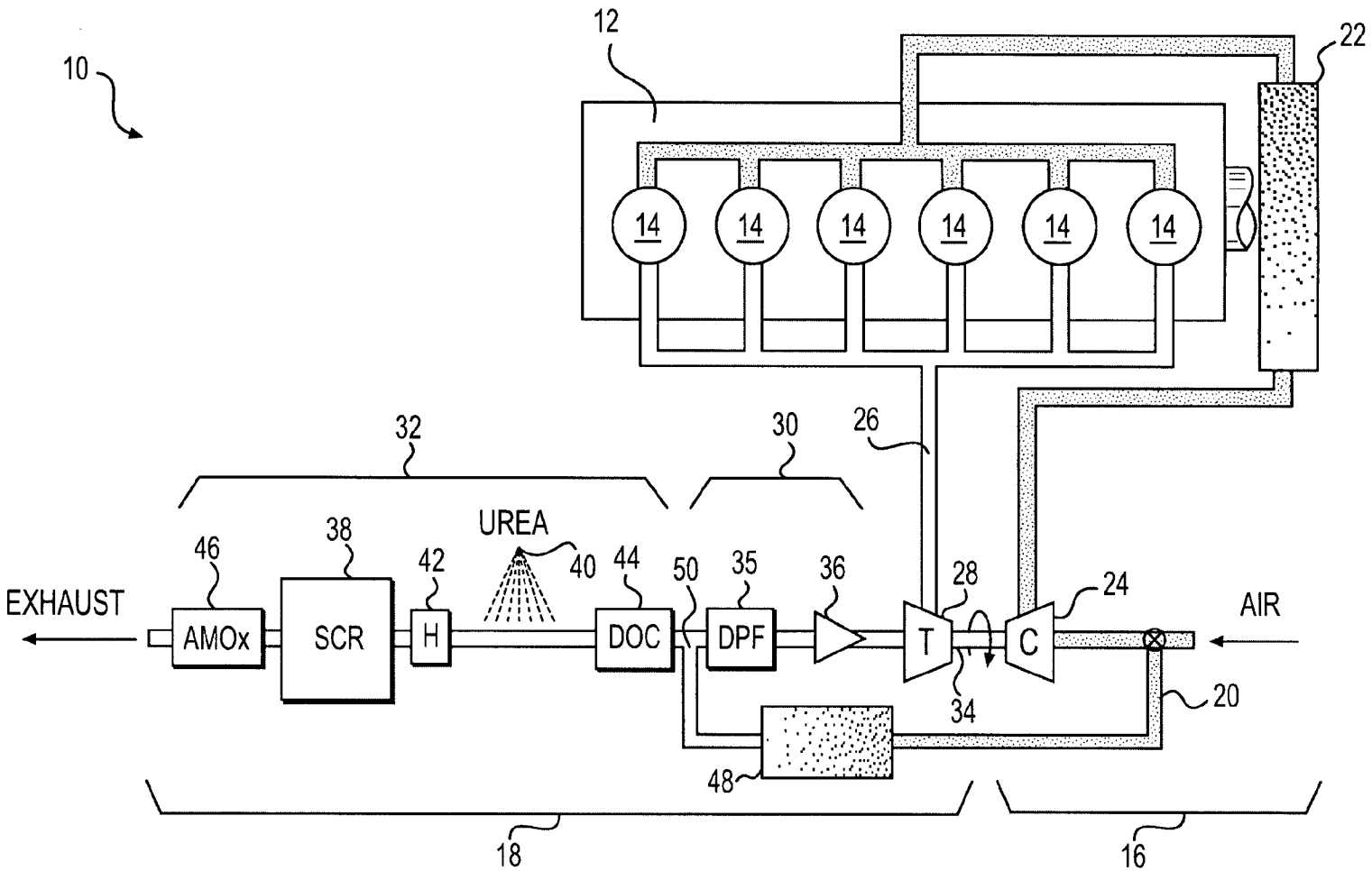
FIG. 1 is a schematic and diagrammatic illustration of an exemplary disclosed power system.

FIG. 1 illustrates an exemplary power system 10. For the purposes of this disclosure, power system 10 is depicted and described as a diesel-fueled, internal combustion engine. However, it is contemplated that power system 10 may embody any other type of combustion engine, such as, for example, a gasoline or a gaseous fuel-powered engine. Power system 10 may include an engine block 12 at least partially defining a plurality of cylinders 14, and a plurality of piston assemblies (not shown) disposed within cylinders 14 to form combustion chambers. It is contemplated that power system 10 may include any number of combustion chambers and that the combustion chambers may be disposed in an "in-line" configuration, a "V" configuration, or in any other conventional configuration.

Multiple separate sub-system may be included within power system 10. For example, power system 10 may include an air induction system 16, an exhaust system 18, and a recirculation loop 20. Air induction system 16 may be configured to direct air, or an air and fuel mixture, into power system 10 for subsequent combustion. Exhaust system 18 may exhaust byproducts of the combustion to the atmosphere. Recirculation loop 20 may be configured to direct a portion of the gases from exhaust system 18 back into air induction system 16 for subsequent combustion.

Air induction system 16 may include multiple components that cooperate to condition and introduce compressed air into cylinders 14. For example, air induction system 16 may include an air cooler 22 located downstream of one or more compressors 24. Compressors 24 may be connected to pressurize inlet air directed through cooler 22. It is contemplated that air induction system 16 may include different or additional components than described above such as, for example, a throttle valve, variable valve actuators associated with each cylinder 14, filtering components, compressor bypass components, and other known components, if desired. It is further contemplated that compressor 24 and/or cooler 22 may be omitted, if a naturally aspirated engine is desired.

Exhaust system 18 may include multiple components that condition and direct exhaust from cylinders 14 to the atmosphere. For example, exhaust system 18 may include an exhaust passageway 26, one or more turbines 28 driven by the exhaust flowing through passageway 26, a particulate collection device 30 located downstream of turbine 28, and a reduction device 32 fluidly connected downstream of particulate collection device 30. It is contemplated that exhaust system 18 may include different or additional components than described above such as, for example, bypass components, an exhaust compression or restriction brake, an attenuation device, additional exhaust treatment devices, and other known components, if desired.

Turbine 28 may be located to receive exhaust leaving power system 10, and may be connected to one or more compressors 24 of air induction system 16 by way of a common shaft 34 to form a turbocharger. As the hot exhaust gases exiting power system 10 move through turbine 28 and expand against vanes (not shown) thereof, turbine 28 may rotate and drive the connected compressor 24 to pressurize inlet air.

Particulate collection device 30 may include a particulate filter 35 located downstream of turbine 28 to remove soot from the exhaust flow of power system 10. It is contemplated that particulate filter 35 may include an electrically conductive or non-conductive coarse mesh metal or porous ceramic honeycomb medium. As the exhaust flows through the medium, particulates may be blocked by and left behind in the medium. Over time, the particulates may build up within the medium and, if unaccounted for, could negatively affect engine performance.

To minimize negative effects on engine performance, the collected particulates may be passively and/or actively removed through a process called regeneration. When passively regenerated, the particulates deposited on the filtering medium may chemically react with a catalyst, for example, a base metal oxide, a molten salt, and/or a precious metal that is coated on or otherwise included within particulate filter 35 to lower the ignition temperature of the particulates. Because particulate filter 35 may be closely located downstream of engine block 12 (e.g., immediately downstream of turbine 28, in one example), the temperatures of the exhaust flow entering particulate filter 35 may be high enough, in combination with the catalyst, to burn away the trapped particulates. When actively regenerated, heat may be applied to the particulates deposited on the filtering medium to elevate the temperature thereof to an ignition threshold. For this purpose, an active regeneration device 36 may be located proximal (e.g., upstream of) particulate filter 35. The active regeneration device may include, for example, a fuel-fired burner, an electric heater, or any other device known in the art. A combination of passive and active regeneration may be utilized, if desired.

Reduction device 32 may receive exhaust from turbine 28 and reduce constituents of the exhaust to innocuous gases. In one example, reduction device 32 may embody a selective catalytic reduction (SCR) device having a catalyst substrate 38 located downstream from a reductant injector 40. A gaseous or liquid reductant, most commonly urea or a water/urea mixture, may be sprayed or otherwise advanced into the exhaust upstream of catalyst substrate 38 by reductant injector 40. As the reductant is absorbed onto the surface of catalyst substrate 38, the reductant may react with NOx (NO and $NO_2$) in the exhaust gas to form water ($H_2O$) and elemental nitrogen ($N_2$). In some embodiments, a hydrolysis catalyst (H) 42 may be associated with catalyst substrate 38 to promote even distribution and conversion of urea to ammonia ($NH_3$).

The reduction process performed by catalyst substrate 38 may be most effective when a concentration of NO to $NO_2$ supplied to catalyst substrate 38 is about 1:1. To help provide the correct concentration of NO to $NO_2$, an oxidation catalyst 44 may be located upstream of catalyst substrate 38, in some embodiments. Oxidation catalyst 44 may be, for example, a diesel oxidation catalyst (DOC). As a DOC, oxidation catalyst 44 may include a porous ceramic honeycomb structure or a metal mesh substrate coated with a material, for example a precious metal, that catalyzes a chemical reaction to alter the composition of the exhaust. For example, oxidation catalyst 44 may include platinum that facilitates the conversion of NO to $NO_2$, and/or vanadium that suppresses the conversion.

During operation of power system 10, it may be possible for too much urea to be injected into the exhaust (i.e., urea in excess of that required for appropriate $NO_X$-reduction). In this situation, known as "ammonia slip", some amount of ammonia may pass through catalyst substrate 38 to the atmosphere, if not otherwise accounted for. To minimize the magnitude of ammonia slip, another oxidation catalyst (AMOx) 46 may be located downstream of catalyst substrate 38. Oxidation catalyst 46 may include a substrate coated with a catalyst that oxidizes residual $NH_3$ in the exhaust to form water and elemental nitrogen. It is contemplated that oxidation catalyst 46 may be omitted, if desired.

Recirculation loop 20 may redirect gases from exhaust system 18 back into air induction system 16 for subsequent combustion. The recirculated exhaust gases may reduce the concentration of oxygen within the combustion chambers, and simultaneously lower the maximum combustion temperature therein. The reduced oxygen levels may provide fewer opportunities for chemical reaction with the nitrogen present, and the lower temperature may slow the chemical process that results in the formation of $NO_X$. A cooler 48 may be located within recirculation loop 20 to cool the exhaust gases before they are combusted.

In the embodiment of FIG. 1, recirculation loop 20 may include an inlet 50 located to receive exhaust from a point upstream of both oxidation catalyst 44 and reductant injector 40. In this manner, the likelihood of $NO_2$ and/or $NH_3$ gas mixing with moisture that condenses within cooler 48 to form nitric acid and/or ammonium nitrate may be minimized. In addition, oxidation catalyst 44 and the urea sprayed by injector 40 into the exhaust flow may be more effectively utilized to reduce $NO_X$ that might otherwise be exhausted to the environment.

Figure 2:
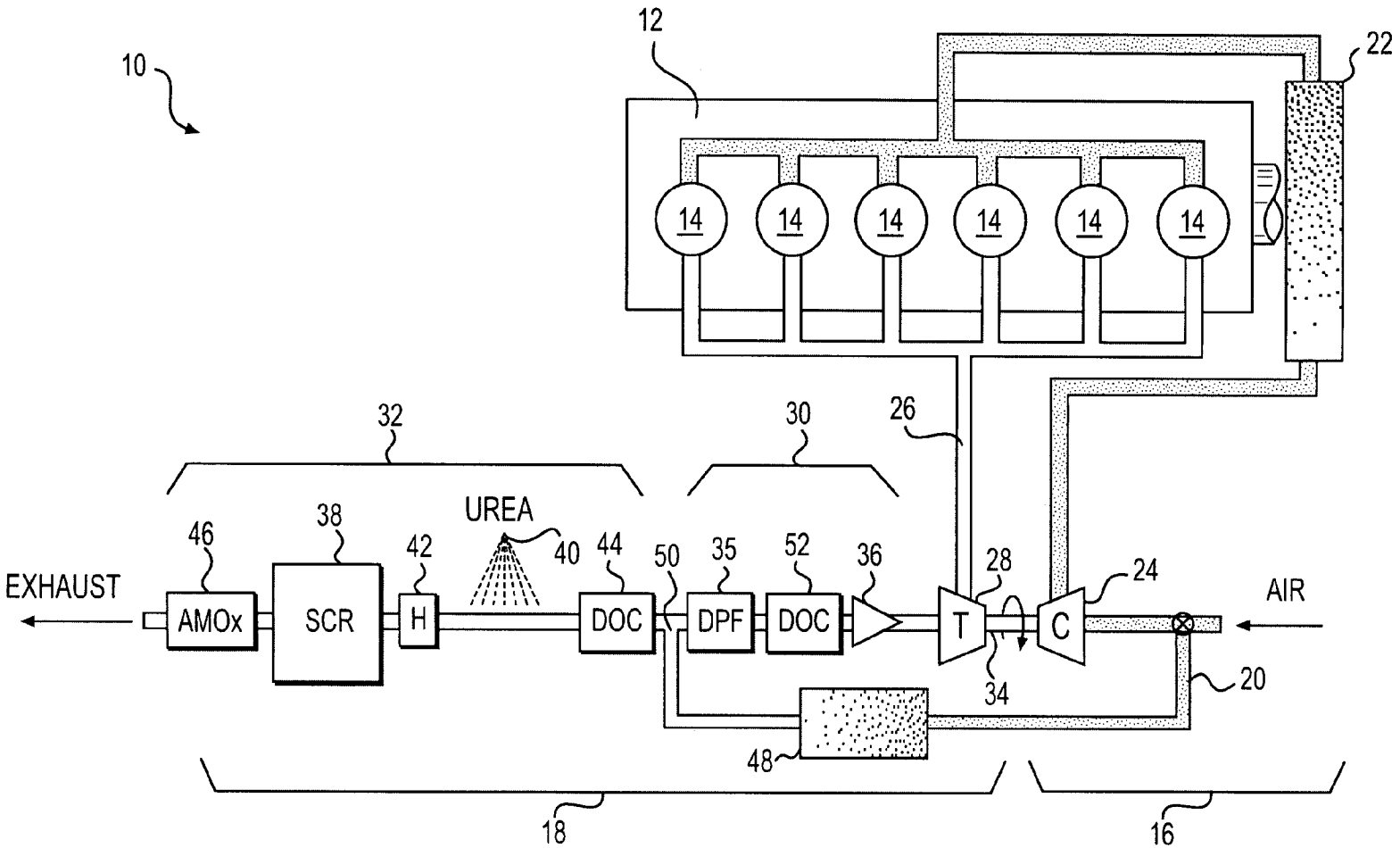
FIG. 2 is another schematic and diagrammatic illustration of another exemplary disclosed power system.

FIG. 2 illustrates an alternative embodiment of power system 10. Similar to the embodiment of FIG. 1, power system 10 of FIG. 2 may also embody an engine having air induction system 16 and exhaust system 18. However, in contrast to the embodiment of FIG. 1, the exhaust system 18 of FIG. 2 may include additional components. For example, exhaust system 18 of FIG. 2 may include an additional oxidation catalyst 52 located upstream of particulate filter 35.

Oxidation catalyst 52, similar to oxidation catalyst 44, may be a diesel oxidation catalyst (DOC) having a porous ceramic honeycomb structure or a metal mesh substrate coated with a precious metal that catalyzes a chemical reaction to convert NO to $NO_2$. However, at this location, oxidation catalyst 52 may perform a function different than that performed by oxidation catalyst 44. That is, instead of providing a precise ratio of NO to $NO_2$ to optimize $NO_X$ reduction by catalyst substrate 38, oxidation catalyst 52 may provide a quantity of $NO_2$ sufficient only for regeneration of particulate filter 35. In this manner, passive and/or active regeneration of particulate filter 35 may be improved without significant amounts of $NO_2$ being generated by oxidation catalyst 52 and passed through cooler 48 of recirculation loop 20. Thus, the likelihood of excess nitric acid formation within cooler 48 may be minimal, even with the addition of oxidation catalyst 52.

Figure 3:
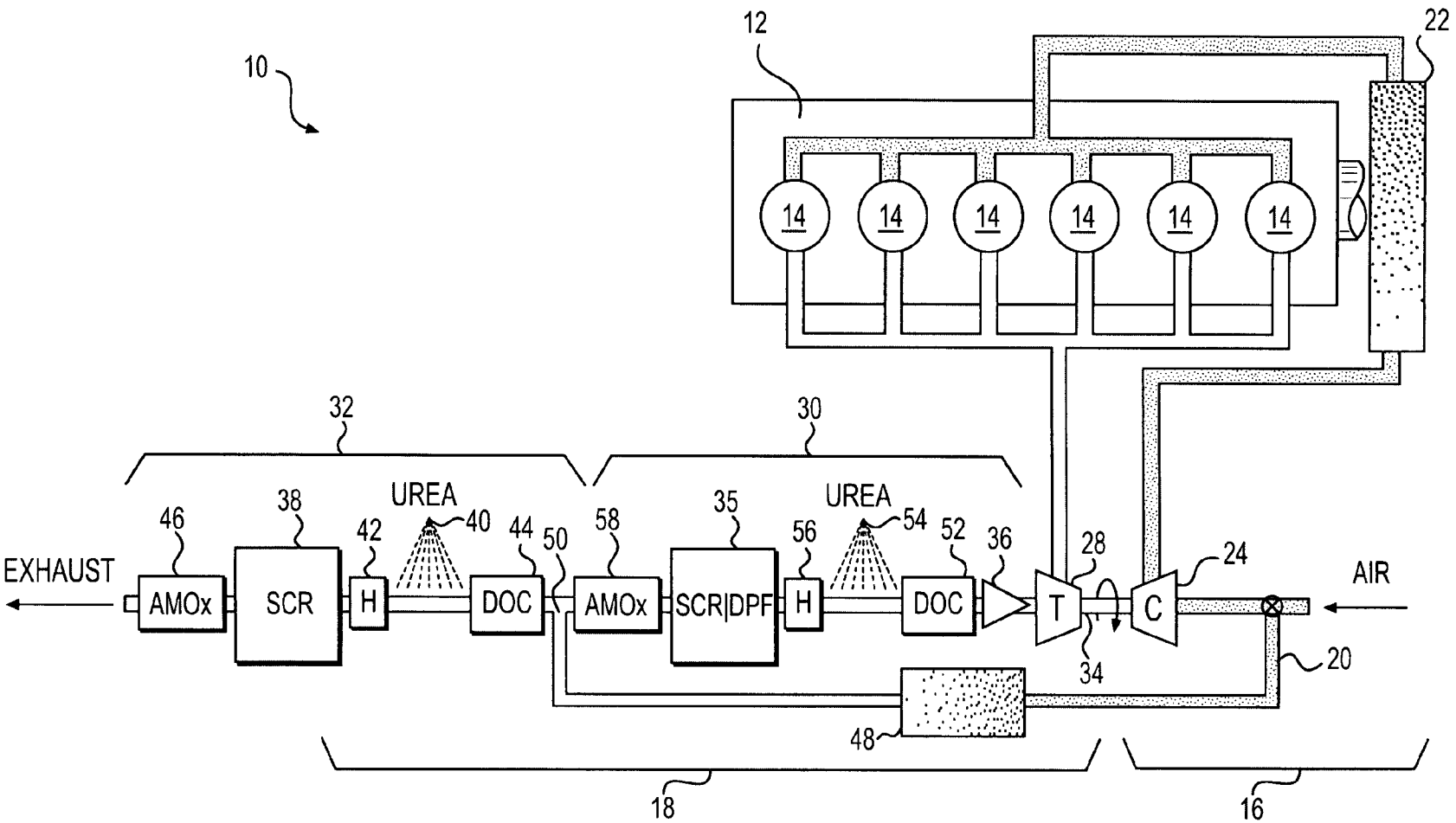
FIG. 3 is yet another schematic and diagrammatic illustration of another exemplary disclosed power system.

FIG. 3 illustrates another alternative embodiment of power system 10. Similar to the embodiment of FIG. 2, power system 10 of FIG. 3 may also embody an engine having air induction system 16 and exhaust system 18. However, in contrast to the embodiment of FIG. 2, the exhaust system 18 of FIG. 3 may include additional components. For example, exhaust system 18 of FIG. 3 may include an additional reductant injector 54, a hydrolysis catalyst 56, and an oxidation catalyst 58.

In the embodiment of FIG. 3, particulate filter 35 may perform additional functions. That is, in addition to removing soot from the exhaust flow, a portion (i.e., the more downstream portion) of particulate filter 35 may be catalyzed to also reduce $NO_X$ (i.e., particulate filter 35 may perform SCR functions). As such, reductant injector 54 may inject urea into the exhaust upstream of particulate filter 35, hydrolysis catalyst 56 may facilitate even distribution and conversion of the urea to ammonia, and oxidation catalyst 58 may remove any residual ammonia from the exhaust stream prior to redirection of the exhaust into air induction system 16 by recirculation loop 20. It is contemplated that the reducing catalyst material of particulate filter 35 may be different than the material of reduction device 32 to accommodate upstream conditions that may be different from downstream conditions such as, for example, exhaust temperatures, if desired.

In the dual stage configuration of FIG. 3, particulate filter 35 may be designed to reduce $NO_X$ by about 70%, while reduction device 32 may further reduce $NO_X$ by about 90% or more of its original concentration. Simultaneously, because of the location of oxidation catalyst 58 upstream of inlet 50, the likelihood of residual ammonia forming ammonium nitrate within cooler 48 may be minimal. Further, because some (i.e., about 70%) of the $NO_X$ present within the exhaust may be reduced by the now catalyzed particulate filter 35, the likelihood of nitric acid formation within cooler 48 may be reduced.

INDUSTRIAL APPLICABILITY

The exhaust system of the present disclosure may be applicable to any power system having reducing and recirculating capabilities, where the formulation of acid (i.e., nitric acid and/or ammonium nitrate) within an associated cooler is a concern. The disclosed exhaust system may minimize the likelihood of acid formation by drawing exhaust for recirculation only from locations low in $NO_2$ and $NH_3$. Operation of power system 10 will now be described.

Referring to FIGS. 1-3, air induction system 16 may pressurize and force air or a mixture of air and fuel into cylinders 14 of power system 10 for subsequent combustion. The fuel and air mixture may be combusted by power system 10 to produce a mechanical work output and an exhaust flow of hot gases. The exhaust flow may contain a complex mixture of air pollutants, which can include the oxides of nitrogen ($NO_X$) and particulate matter. As this exhaust flow is directed from cylinders 14 through particulate collection device 30 and reduction device 32, soot may be collected and burned away, and $NO_X$ may be reduced to $H_2O$ and $N_2$. Simultaneously, exhaust low in $NO_2$ and $NH_3$ may be drawn through cooler 48 and redirected back into air induction system 16 for subsequent combustion, resulting in a lower production of $NO_X$ by power system 10.

It will be apparent to those skilled in the art that various modifications and variations can be made to the system of the present disclosure without departing from the scope of the disclosure. Other embodiments will be apparent to those skilled in the art from consideration of the specification and practice of the system disclosed herein. It is intended that the specification and examples be considered as exemplary only, with a true scope of the disclosure being indicated by the following claims and their equivalent.

What is claimed is:

1. An exhaust system, comprising:

an exhaust passageway;

a reduction catalyst located within the exhaust passageway;

a particulate filter located within the exhaust passageway upstream of the reduction catalyst, at least part of the particulate filter being catalyzed to reduce $NO_X$;

a first oxidation catalyst located within the exhaust passageway upstream of the reduction catalyst to provide a desired ratio of $NO:NO_2$ to the reduction catalyst;

an exhaust gas recirculation loop situated to receive exhaust from the exhaust passageway at a location upstream of the first oxidation catalyst and downstream of the particulate filter;

a first injector located to inject reductant into the exhaust passageway upstream of the reduction catalyst, wherein the exhaust gas recirculation loop is situated to receive exhaust from the exhaust passageway at a location upstream of both the first oxidation catalyst and the first injector;

a second injector located to inject reductant into the exhaust passageway upstream of the particulate filter; and a second oxidation catalyst located downstream of the particulate filter and upstream of the location from which the exhaust gas recirculation loop receives exhaust to remove residual reductant from the exhaust.

2. The exhaust system of claim 1, wherein the first injector is located downstream of the first oxidation catalyst.

3. The exhaust system of claim 1, further including a regeneration device located upstream of the particulate filter.

4. The exhaust system of claim 1, wherein the second oxidation catalyst is located downstream of the reduction catalyst to oxidize residual reductant.

5. The exhaust system of claim 1, further including a hydrolysis catalyst located upstream of the reduction catalyst.

6. The exhaust system of claim 1, further including a third oxidation catalyst located upstream of the second injector to convert NO to $NO_2$.

7. The exhaust system of claim 6, further including a fourth oxidation catalyst located downstream of the reduction catalyst to remove residual reductant.

8. The exhaust system of claim 1, further comprising a third oxidation catalyst located upstream of the particulate filter.

9. The exhaust system of claim 8, wherein:

the first oxidation catalyst is coated to provide a desired ratio of $NO:NO_2$ to the reduction catalyst; and the third oxidation catalyst is coated to convert only enough NO to $NO_2$ for regeneration of the particulate filter.

10. A power system comprising:

an engine;

an exhaust passageway extending from the engine to the atmosphere;

an SCR catalyst located within the exhaust passageway;

a first injector located to inject urea into the exhaust passageway upstream of the SCR catalyst;

a diesel particulate filter located within the exhaust passageway upstream of the SCR catalyst, at least part of the diesel particulate filter being catalyzed to reduce $NO_X$;

a first diesel oxidation catalyst located within the exhaust passageway upstream of the SCR catalyst and the first injector, the first diesel oxidation catalyst being coated to provide a desired ratio of $NO:NO_2$ to the SCR catalyst;

an exhaust gas recirculation loop situated to receive exhaust from the exhaust passageway at a location upstream of both the first injector and the diesel oxidation catalyst, and downstream of the diesel particulate filter;

a second injector located to inject urea into the exhaust passageway upstream of the diesel particulate filter;

an ammonia oxidation catalyst located downstream of the diesel particulate filter and upstream of the location from which the exhaust gas recirculation loop receives exhaust to remove residual urea from the exhaust; and a second diesel oxidation catalyst located upstream of the second injector to convert enough NO to $NO_2$ for regeneration of the diesel particulate filter and to provide a desired ratio of $NO:NO_2$ to the catalyzed diesel particulate filter.

11. An exhaust system, comprising:

an exhaust passageway;

a reduction catalyst located within the exhaust passageway;

a particulate filter located within the exhaust passageway upstream of the reduction catalyst, at least part of the particulate filter being catalyzed to reduce $NO_X$;

a first oxidation catalyst located within the exhaust passageway upstream of the reduction catalyst to provide a desired ratio of $NO:NO_2$ to the reduction catalyst;

an exhaust gas recirculation loop situated to receive exhaust from the exhaust passageway at a location upstream of the first oxidation catalyst and downstream of the particulate filter;

a first injector located to inject reductant into the exhaust passageway upstream of the reduction catalyst and downstream of the particulate filter, wherein the first injector is located downstream of the first oxidation catalyst, and wherein the exhaust gas recirculation loop is situated to receive exhaust from the exhaust passageway at a location upstream of both the first oxidation catalyst and the first injector; and a second injector located to inject reductant into the exhaust passageway upstream of the particulate filter.

12. The exhaust system of claim 11, further including a regeneration device located upstream of the particulate filter.

13. The exhaust system of claim 11, further comprising a second oxidation catalyst located downstream of the reduction catalyst to oxidize residual reductant.

14. The exhaust system of claim 11, further comprising a second oxidation catalyst located upstream of the particulate filter.

15. The exhaust system of claim 14, wherein:

the first oxidation catalyst is coated to provide a desired ratio of $NO:NO_2$ to the reduction catalyst; and the second oxidation catalyst is coated to convert only enough NO to $NO_2$ for regeneration of the particulate filter.

16. An exhaust system, comprising:

an exhaust passageway;

a reduction catalyst located within the exhaust passageway;

a particulate filter located within the exhaust passageway upstream of the reduction catalyst, at least part of the particulate filter being catalyzed to reduce $NO_X$;

a first oxidation catalyst located within the exhaust passageway upstream of the reduction catalyst to provide a desired ratio of $NO:NO_2$ to the reduction catalyst;

an exhaust gas recirculation loop situated to receive exhaust from the exhaust passageway at a location upstream of the first oxidation catalyst and downstream of the particulate filter;

a first injector located to inject reductant into the exhaust passageway upstream of the reduction catalyst and downstream of the particulate filter, wherein the exhaust gas recirculation loop is situated to receive exhaust from the exhaust passageway at a location upstream of both the first oxidation catalyst and the first injector;

a second injector located to inject reductant into the exhaust passageway upstream of the particulate filter; and a second oxidation catalyst located upstream of the second injector to convert NO to $NO_2$.

17. The exhaust system of claim 16, further including a third oxidation catalyst located downstream of the reduction catalyst to remove residual reductant.

18. An exhaust system, comprising:

an exhaust passageway;

a reduction catalyst located within the exhaust passageway;

a particulate filter located within the exhaust passageway upstream of the reduction catalyst, at least part of the particulate filter being catalyzed to reduce $NO_X$;

a first oxidation catalyst located within the exhaust passageway upstream of the reduction catalyst to provide a desired ratio of $NO:NO_2$ to the reduction catalyst;

an exhaust gas recirculation loop situated to receive exhaust from the exhaust passageway at a location upstream of the first oxidation catalyst and downstream of the particulate filter;

a first injector located to inject reductant into the exhaust passageway upstream of the reduction catalyst and downstream of the particulate filter, wherein the exhaust gas recirculation loop is situated to receive exhaust from the exhaust passageway at a location upstream of both the first oxidation catalyst and the first injector;

a second injector located to inject reductant into the exhaust passageway upstream of the particulate filter; and a hydrolysis catalyst located upstream of the reduction catalyst.

* * * * *